US005512799A

United States Patent [19]

Waymouth

[11] Patent Number: 5,512,799

[45] Date of Patent: Apr. 30, 1996

[54] GLOWBOTTLE STARTING DEVICE FOR GASEOUS DISCHARGE DEVICES

[75] Inventor: John F. Waymouth, Marblehead, Mass.

[73] Assignee: John F. Waymouth Intellectual Property and Educational Trust, Marblehead, Mass.

[21] Appl. No.: 328,442

[22] Filed: Oct. 25, 1994

[51] Int. Cl.[6] ..... H01J 7/36; H01J 7/30

[52] U.S. Cl. ..... 313/567; 313/619; 313/498; 315/73; 315/47; 337/27

[58] Field of Search ..... 313/567, 619, 313/589, 498, 502, 512; 315/169.3, 73, 47; 337/22, 23, 24, 25, 26, 27

[56] References Cited

U.S. PATENT DOCUMENTS

| | | | |
|---|---|---|---|
| 3,103,607 | 9/1963 | Rulon | 313/502 |
| 3,107,179 | 10/1963 | Rindone | 427/101 |
| 3,219,008 | 9/1965 | Harris et al. | 116/286 |
| 3,283,194 | 11/1966 | Rulon | 313/509 |
| 4,818,915 | 4/1989 | Zaslavsky et al. | 315/60 |
| 4,843,282 | 6/1989 | Barakitis et al. | 313/619 |
| 4,987,344 | 1/1991 | Zaslavsky et al. | 315/59 |
| 5,001,391 | 3/1991 | Kling et al. | 313/619 |

*Primary Examiner*—Donald J. Yusko
*Assistant Examiner*—Nimesh Patel

[57] ABSTRACT

A glowbottle starter switch for igniting gaseous discharge lamps in alternating current circuits. The glowbottle including a hermetically sealed glass envelope (7) containing a fill of an ionizable gas and having at least two lead wires (2,3) disposed therein and extending to the exterior of the envelope (7) and a bimetal switch (4) disposed on at least one of the lead wires (3). The switch (4) is arranged to move within a gap to contact the other of the lead wires (2). An electroluminescent light emitter including an electroluminescent phosphor (6 in FIG. 1) is disposed in optically-contiguous relationship with the glowbottle. The electroluminescent light emitter is arranged to be energized to emit light by electric fields produced by alternating voltage between the lead wires (2,3). Light emission causes a photoelectric emission of electrons from interior surfaces within the glowbottle envelope (7) to serve as initial electrons for electron avalanches promoting the ionization and breakdown of the gasses within the gap between electrodes (4, 2) of the glowbottle.

15 Claims, 9 Drawing Sheets

GLOWBOTTLE STARTING DEVICE FOR GASEOUS DISCHARGE DEVICES

BACKGROUND OF THE INVENTION

The present invention relates to an improvement in a glowbottle starter for lamps. Glowbottle starters are well-known gaseous discharge forming devices which have been used commercially to ignite lamps for at least fifty years. Such a device consists of a small hermetically-sealed vial containing two spaced electrodes, at least one of which is a bimetal. The air has been exhausted from the interior of the vial and replaced by a selected gas at a predetermined pressure. In use, one electrode terminal of the glowbottle is connected to one end of a first filament of the fluorescent lamp and the other electrode terminal is connected to one end of the other (second) filament of the fluorescent lamp. The high voltage output of the power circuit energizing the lamp, a ballast, is connected to the other end of the first filament. The current return lead of the ballast is connected to the other end of the second filament.

When a high potential is applied by the ballast to the combination of the lamp, the glowbottle and the starter, the two filaments of the lamp and the interelectrode gap of the glowbottle are effectively in series connection across the high potential. The electrode surface composition, the interelectrode gap and gas filling pressure of the glowbottle are selected so that the gas within the glowbottle ionizes and a cold-cathode glow discharge is established between the two electrodes. The ion bombardment of the glow discharge heats the bimetal electrode causing it to deflect and contact the other electrode of the glowbottle to establish a short-circuit connection as with the closure of a switch.

The lamp-glowbottle circuit then has the two lamp filaments connected through the closed glowbottle switch in series across the output terminals of the ballast. A current flows through them, limited primarily by the impedance of the ballast. The filaments are heated to thermionic emission temperatures by the flowing current, but the bimetal in the glowbottle is substantially not heated since its resistance is deliberately made low to minimize such heating. Thus, the bimetal cools, "unbends", and ceases to contact the other electrode of the glowbottle, thereby opening the switch. Since the ballast impedance includes an inductive component, the interruption of current by the opening of the switch generates a high transient pulse voltage. The high voltage pulse appears across the fluorescent lamp interelectrode gap, with the lamp electrodes heated to thermionic-emitting temperatures. The lamp ignites and current flows through the fluorescent lamp, determined by the ballast open circuit voltage, the lamp operating voltage at the operating current, and the ballast series impedance. The potential now appearing across the glowbottle terminals is the lamp operating voltage, typically less than one half the ballast open-circuit voltage. The gap and pressure parameters of the glowbottle are chosen in such a way that this potential is inadequate to cause ionization and breakdown therein. Thus the glowbottle remains inert and passive until the fluorescent lamp is extinguished and is re-started during its next operating cycle.

The design and manufacturing requirements on the glowbottle are: (1) it must ionize and conduct and close its bimetal switch at the open-circuit voltage generated by the ballast power circuit at the lowest value of line voltage permitted by the specified tolerances and (2) it must not ionize, conduct, or close its bimetal switch at the highest value of lamp voltage permitted by the specified tolerances. These two requirements establish stringent conditions on interelectrode gap, fill gas composition and pressure, and electrode surface composition in the glowbottle.

Despite the relative complexity of the lamp ignition process and the demanding conditions imposed on glowbottle characteristics, this lamp-ballast-starter system has been extensively refined and improved in performance, reliability and cost over the last half century to the extent that it is the least expensive system for igniting and controlling fluorescent lamps and is the preferred system wherever 240 volts is the predominant local distribution voltage and the ballast is a simple series choke. It is, in addition, the preferred system for operation of so-called compact fluorescent lamps even on 120-volt power distribution systems. It is commonplace to include the glowbottle starter within the base of a compact fluorescent lamp, so that only a series inductive choke is required in the fixture to connect the lamp to the power grid.

The above list of advantages notwithstanding, the glowbottle starter device suffers from an intrinsic problem which may lead to undesirable constraints in design parameters and which may compromise performance of the glowbottle. This stems from the fact that the breakdown and ionization process within the glowbottle itself depends on the presence of at least one free electron in the gas to initiate a Townsend avalanche and trigger the breakdown and subsequent current flow that causes bimetal closure. If there is no free electron available at the time that open-circuit voltage is applied, nothing happens. The ionization and glow current through the glow bottle is delayed until at least one free electron appears. Thus there is a delay between the application of voltage and the commencement of the starting cycle. The maximum time delay between application of open-circuit voltage and glowbottle closure is a performance specification for many systems. For other systems, the time delay between application of open circuit voltage and fluorescent lamp ignition is specified. However, even for this specification, the delay time between voltage application and glowbottle closure may be an important fraction of the allowed starting time.

A problem which arises in this connection is the so-called photoelectric effect. The presence of ambient light incident on the glowbottle can result in the emission internally of photoelectrons from electrode or glass surfaces. These photoelectrons may then provide the free electrons needed for initiation of Townsend avalanches and the breakdown and ionization within the glowbottle. In the absence of light, there is no such contribution to the provision of initial electrons. Therefore, the time delay in ionization may depend on whether the glowbottle is in the dark or in an illuminated location.

Furthermore, the breakdown and ionization process is statistical in nature. If there are many thousands of initial electrons, each of which produces an electron avalanche and only one such avalanche needs to successfully liberate new electrons from the cathode thereby regenerating itself, the mean breakdown voltage can be lower than if there is only one free electron. For successful breakdown with one initiating electron, the probability must be 100% that the avalanche creates enough free electrons and enough ions returning to the cathode to liberate one additional free electron thereby generating a new avalanche. To achieve this will require higher electric field strength and higher voltage across the gap than would be required if there were a million free electrons and the probability of a "successful" avalanche needed only to be one in a million. Therefore, in addition to the time delay intrinsic in having to wait for a free electron under conditions of a limited supply, there is also a higher mean voltage required to insure reliable breakdown. In the domain of operation of glowbottles, breakdown voltage increases with increasing product of pressure times gap separation, that is the "pd-product". When there is a very limited supply of initial electrons, the pd-product of the bimetal interelectrode gap must be lower to insure reliable breakdown at a given voltage than would be the case if there were an ample supply.

In the practical sense, this means that in the absence of some method to generate free electrons, the gap pd-product must be reduced to provide near 100% breakdown probability at the required "closure voltage" with the glowbottle in the dark. However, once the fluorescent lamp lights, the glowbottle is usually somewhat illuminated by light from the lamp itself tending to lower its average breakdown voltage. It may happen that with the bottle illuminated, the breakdown voltage resulting from the combination of ample supply of initial electrons plus the reduced pd-product may be lowered to the extent that some bottles will ionize and reclose at the operating voltage of the lamp. This is especially a problem with compact fluorescent lamps, which have a much higher reignition peak voltage every half cycle relative to rms operating voltage than do conventional large diameter lamps. The combination of high peak voltage and lowered breakdown voltage due to photoelectrically-emitted initiating electrons may lead to ionization and possible reclosure during operation. This possible tendency to reclose is of course increased if the pd-product had to be chosen to reduce average breakdown voltage to insure reliable breakdown with only one initiating electron. In any case, the lowering of mean breakdown voltage with the lamp lit will reduce the difference between glowbottle breakdown voltage and operating voltage of the lamp requiring tighter manufacturing tolerances to insure reliable closure with the glowbottle in the dark and non-closure with the glowbottle illuminated.

For these reasons it is common in glowbottle manufacture to seek to provide an ample supply of free electrons to initiate breakdown with the glowbottle in the dark. Thus, the presence of additional free electrons from photoelectric emission when the glowbottle is illuminated will have negligible effect on breakdown voltage. There will be substantially no difference in mean breakdown voltage between bottle-illuminated and bottle-in-the-dark states. Thereby, there will be no narrowing of tolerances to insure reliable closure in the dark simultaneously with reliable non-reclosure with the glowbottle illuminated. Moreover, the provision of an ample supply of free electrons to initiate the breakdown in the glowbottle will eliminate the so-called "statistical time lag" between the application of voltage and the closure of the bimetal switch. This will enhance the ease of meeting the starting time specifications for the bottle-in-the-dark state.

It is known to the prior art to employ radioactive substances within the glowbottle to provide initial electrons. Commonly the radioactive isotope krypton-85 is added to the fill gas in nanocurie to microcurie amounts. Beta-rays of 0.72 MEV energy from disintegrating Kr-85 nuclei produce copious ionization within the gas, which furnishes a substantial supply of free electrons to initiate Townsend avalanches and cause breakdown. An isotope of hydrogen, tritium, has also been employed as a gaseous dopant. Its beta-rays of 18 KEV energy also produce ionization in the gas. An advantage of tritium over krypton-85 is that no gamma-rays are emitted by tritium. Therefore, all the ionizing radiation emitted is contained within the glowbottle, since the beta-rays are not transmitted through the glass. In addition to beta-rays, krypton-85 emits 0.54 MEV gamma-rays, which penetrate through the glass wall of the glowbottle, the metal or plastic cover of the glowbottle, and any other housing which may be present. Thus, ionizing radiation is deposited in the space surrounding the glowbottle offering the possibility of radiation hazard. It is common in the prior art to point out that because of the very low level of radioactivity required, the ionizing radiation delivered outside the glowbottle is negligible in comparison to normal background radiation, and there is therefore no radiation hazard. Regulatory authorities have agreed as to a lack of hazard and do not require "Radioactive" labels to be affixed to products or packages.

It is also known to the prior art to dispose thorium in some form within the glowbottle, for example, thorium oxide, thorium metal or the like. Thorium has several long-lived radioactive isotopes, emitting alpha, beta, and gamma rays, forming daughter products which are themselves radioactive. The alpha and beta rays produce copious ionization within the gas, providing free electrons to serve as initial electrons in the breakdown process. Again, the gamma component of the radiation escapes the glowbottle to the ambient, but again the quantity of radiation is so small that the prior art has considered there to be negligible radiation hazard.

Although there is insignificant radioactive hazard from glowbottles in service in the marketplace, there is a radioactive hazard in manufacture. Relatively large quantities of krypton-85, tritium or thorium must be handled safely in the manufacture of hundreds of millions of glowbottles every year. Bulk shipment or warehousing of glowbottles in quantity may result in the presence at a single location of significant quantities of radioactive material.

It is apparent that some other means of providing initiating electrons without the use of radioactive materials would be highly desirable, but has not been available to manufacturers.

OBJECTS OF THE INVENTION

An object of the invention to provide non-radioactive sources of initial electrons interior to a glowbottle in the dark, to facilitate breakdown, to minimize statistical time lag in breakdown and to minimize the reduction in breakdown voltage which would otherwise occur when the glowbottle is illuminated. Such non-radioactive sources are used to achieve a reliability of closure and non-closure performance of the bimetal and relatively wide manufacturing tolerances for gap spacing, gas composition, and pressure afforded by the use of radioactive dopants without any of the disadvantages of the radioactive dopants.

A further object of the invention to so provide a non-radioactive source of initial electrons which can be implemented with minimal cost increase.

SUMMARY OF THE INVENTION

The invention in its most elemental form comprises the disposition of a small quantity of electroluminescent (EL) phosphor situated to be energized by the voltage appearing across the glowbottle lead wires. The EL phosphor is disposed in an optically-contiguous relationship with the interior of the glowbottle. The photons emitted by the EL phosphor permeate the interior of the glowbottle and liberate photoelectrons from surfaces therein, thereby providing a copious source of free electrons to initiate electron avalanches which provide all the advantages formerly obtained only with radioactive dopants. Because of the copious provision of initiating electrons from this source, the breakdown characteristics of the glowbottle are independent of whether it is in the dark or illuminated. Statistical time delay is minimized, reducing the time to closure of the bimetal and reducing the starting time of the glowbottle-lamp combination.

According to the present invention I provide a glowbottle starter switch for igniting fluorescent lamps in alternating current circuits. The glowbottle includes a hermetically sealed envelope containing a fill of an ionizable inert gas and having at least two lead wires disposed therein. A bimetal switch is disposed on at least one of the lead wires and is arranged to move within a gap to contact or break contact with the other of the lead wires. An EL phosphor dispersed in a dielectric is disposed in optically-contiguous relationship with the glowbottle and is arranged to be energized to emit light by electric fields produced by alternating voltage between the lead wires. The light emission causes a photoelectric emission of electrons from interior surfaces within the glowbottle envelope which serve as initial electrons for electron avalanches promoting the ionization and breakdown of the inert gasses within the gap between electrodes of the glowbottle. Upon application of the open-circuit voltage for starting the lamp, the field strength is the highest, stimulating the EL phosphor to emit light. Some of the photons are directed toward the interior of the glowbottle. Some of these photons liberate photoelectrons from interior surfaces and provide free electrons to initiate the Townsend avalanches and the breakdown process within the glowbottle. Thus the light from the EL phosphor has the same effect on the glowbottle operation as does a radioactive dopant, without the disadvantages thereof described above.

BRIEF DESCRIPTION OF THE DRAWINGS

FIG. 1A is an enlarged view of the bead and lead wires.

FIG. 2A is an enlarged view of the bead on one of the lead wires.

FIG. 3A is an enlarged view of the bead on one of the lead wires and the conductive layer.

FIG. 4A is a cross sectional view taken along the line 4—4 of FIG. 4.

FIG. 6A is an enlarged cross sectional view taken along the line 6—6 of FIG. 6.

FIG. 7A is an enlarged cross sectional view taken along the line 7—7 of FIG. 7.

DESCRIPTION OF THE PREFERRED EMBODIMENTS

Figure 1:
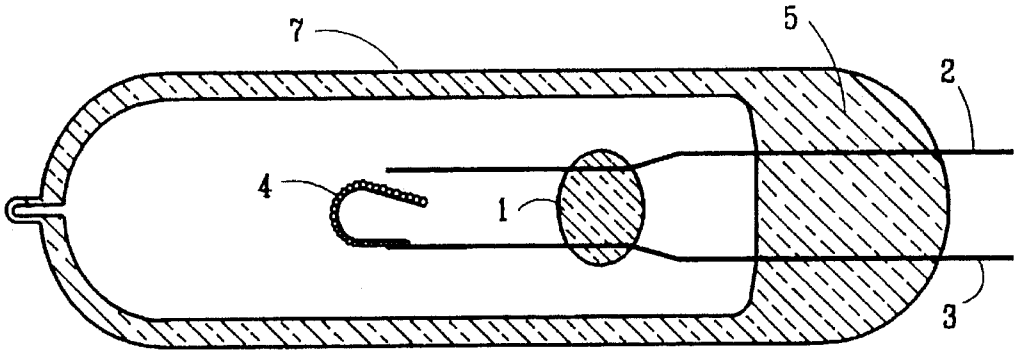
FIGS. 1 and 1A: Illustrates a glowbottle manufactured using a so-called "beaded construction" wherein a glass bead fused to the lead wires is used to fix the position of the lead wires while making a hermetic pinch seal around the lead wires. Particles of EL phosphor are dispersed within the glass bead to be energized by the alternating potential between the lead wires.
Figure 1A:
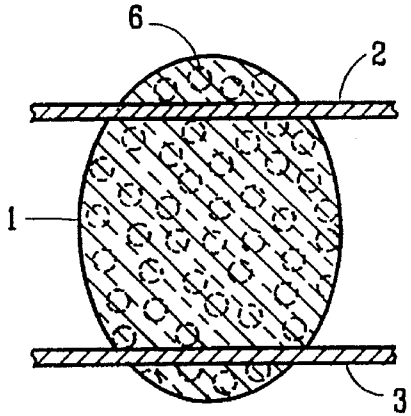

Preliminary examination of the Figures together with the fundamental concept of the invention disclosed above demonstrates that when an EL phosphor dispersed within a dielectric material is disposed in regions where there is an alternating electric field produced by the AC potential between the glowbottle lead wires, upon application of the open-circuit voltage for starting the lamp, this field strength is the highest, stimulating the EL phosphor to emit light. Some of these photons of light are directed toward the interior of the glowbottle and may liberate photoelectrons from interior surfaces, providing free electrons to initiate the Townsend avalanches and the breakdown process within the glowbottle. Thus the light from the EL phosphor has the same effect on the glowbottle operation as does a radioactive dopant without the disadvantages thereof described above.

Embodiment 1: (FIG. 1) In many glowbottles, a glass bead 1 is employed to fix the position of the lead wires 2 and 3 for mounting the bimetal 4 and for fusing the lead wires hermetically into a pinch seal 5 of a glowbottle 7. In a first embodiment of the invention, particles of EL phosphor 6 are dispersed within the glass bead 6. To maximize the yield of photoelectrons, the spectral power distribution of the EL emission should be of shorter visible wavelengths, for example green, blue green, or blue. Such EL emissions will have higher photon energy than those of yellow-emitting EL phosphors. Suitable EL phosphors are supplied by Osram-Sylvania, Inc., Chemical and Metallurgical Products Division, Towanda, Pa. 18848, U.S.A., as follows: Type 814, ZnS:Cu (blue-emitting, peak emission wavelength 456 nm); Types 813, 729, ZnS;Cu (blue-green emitting, peak emission wavelength 511, 510 nm, respectively); Types 727, 728, ZnS:Cu (green emitting, peak emission wavelengths 516, 515 nm, respectively)

It is known to the prior art to disperse EL phosphor particles in a fused-glass dielectric, as taught for example in the following U.S. Pat. Nos. 2,906,631, dated Sep. 29, 1959, to Guy E. Rindone; 3,103,607, dated Sep. 10, 1963, to Richard M. Rulon; or 3,107,178, dated Oct. 15, 1963, to Guy E. Rindone. The use of glass dielectrics has the advantage of protecting the EL phosphor from the adverse influence of moisture, thereby providing excellent maintenance of light output and extremely long life. This advantage is of little value in the example of Embodiment 1, since there is no moisture in the interior of the glowbottle vessel anyway, but its advantages will become apparent in later embodiments. The choice of glass dielectric for this example is predicated on ease of manufacture and because no extraneous materials beyond those customarily present are exposed within the glowbottle vessel. Thus, the disposition of EL material into the interior of the glowbottle vessel does not introduce any contaminants to affect adversely the glowbottle properties or performance. Such might not be the case if the EL phosphor were contained in a plastic dielectric, for example.

Fabrication of beads is customarily carried out by the following sequence of steps. Glass is crushed to a powder, blended with a binder and pressed into a ring-shaped member. The ring-shaped member is then fired under controlled conditions to burn out the binder and lightly sinter the glass particles together to maintain dimensional integrity in subsequent handling. The sintered ring-shaped member is then slipped over the two lead wires held at fixed spacing in a jig, and the ring is softened to melting temperature by a gas flame. The glass forms a "bead" and fuses to the two lead wires. After the flame is removed and the glass solidifies, the lead wires are held at fixed spacing by the fused bead bridging them, and may be removed from the jig for subsequent operations. Note that a hermetic seal between bead and lead wires is not required, since the bead member is not part of the vessel closure. Minor cracking at the bead-to-wire interface is permissible.

To incorporate EL phosphor into the bead, the powdered EL phosphor material may be blended with the crushed and powdered glass in the first mixing step. It may be necessary to modify the glass composition as well as the subsequent sintering temperatures and fusing temperatures to avoid overheating the phosphor and damaging it. The determination of the appropriate concentrations of EL phosphor in the glass, as well as of glass composition, optimum process conditions and temperatures to produce a satisfactory EL bead are considered to be matters of routine experimentation to be performed by one of ordinary skill in the art once the teachings of the invention are understood and appreciated, and are therefore within the scope of the invention.

The EL response depends on the AC field strength by which the particles are energized. Such field strength can be approximately calculated as a function of position within the bead from the following formula:

$$\vec{E} = \frac{V((1/\vec{r}_1) + (1/\vec{r}_2))}{\mathrm{Ln}(D/2S)}$$

in which D is lead wire diameter, S is spacing between lead wires, $r_1$ is the vector distance from the point at which calculation of E is desired to the center of the first lead wire and $r_2$ is the vector instance to the center of the second lead wire. The formula is valid for spacing large in comparison to wire diameter.

It can be seen that the maximum value of electric field strength will be obtained directly at the surface of the wires, where $r_1$ or $r_2$ equals D/2, because of the inverse dependence of E on distance. For lead wires of 0.020" diameter spaced 0.125" apart and 240 volts between lead wires, this maximum field strength is about 4000 volts/cm. It is customary to energize EL phosphors in EL lamps at higher field strengths: 10,000–50,000 volts/cm. In the low-field domain EL intensity decreases approximately exponentially with field strength. Thus the EL intensity obtained from the phosphor-doped bead may be quite weak.

However, for blue-green light, there are approximately $2.5\times10^{16}$ photons per second emitted per lumen. An EL luminescence intensity of one microlumen still will result in $2.5\times10^{10}$ photons per second bathing the interior of the glowbottle. Even for the relatively low photoelectric yield of 0.1 percent there will be $2.5\times10^{7}$ electrons per second liberated to serve as initial electrons for Townsend avalanches. For comparison purposes, one nanocurie of krypton-85 will result in the liberation of about $10^6$ electrons per second. Thus, only very small quantities of light need be generated to have equivalent effect.

Note that the EL phosphor within the bulk of the bead is relatively ineffective because it is excited in a much lower field strength than that immediately at the wire surface. Thus, the quantity of EL phosphor may be reduced and the cost reduced by "fritting" the lead wire with a thin layer of suspension of phosphor particles and powdered glass in a binder vehicle, which is subsequently fused to the lead wire with gas flame. A standard bead (containing no EL phosphor) is then applied to the fritted lead or leads. Again the establishment of suitable concentrations of EL phosphor in the frit layer and the adjustment of process conditions for optimum performance are matters of routine experimentation by one of ordinary skill in the art once the teachings of the invention have been understood and appreciated.

Note also that simple substitution of EL phosphor doped bead for standard bead in the glowbottle shown in FIG. 1 without other changes may not yield the full advantage of the invention. If there had been no prior specific means of providing initiating electrons, the gap pd-product may have had to be adjusted downward to insure reliable closure at the lowest ballast open circuit voltage. Substitution of the EL phosphor doped bead provides sufficient free electrons that the mean breakdown potential in the dark is lowered below the required level, although there will be little effect on the breakdown voltage to light the fluorescent lamp. To obtain the full advantage of the invention, the pd-product may be increased and/or the fill gas composition or the composition of the electrode surfaces may be changed to return the dark breakdown voltage to the maximum value consistent with reliable dark starting. This will simultaneously increase the breakdown voltage with fluorescent lamp lighted, increasing the margin of safety between closure voltage and lamp operating voltage. Such experimentation to find new optimum electrode composition, gas composition or pd-product of a glowbottle for use with the EL source of initial electrons is considered to be a matter of routine experimentation to be carried out by one of ordinary skill in the art once the teachings of the invention have been understood and appreciated, and therefore remains within the scope of the invention.

Figure 2:
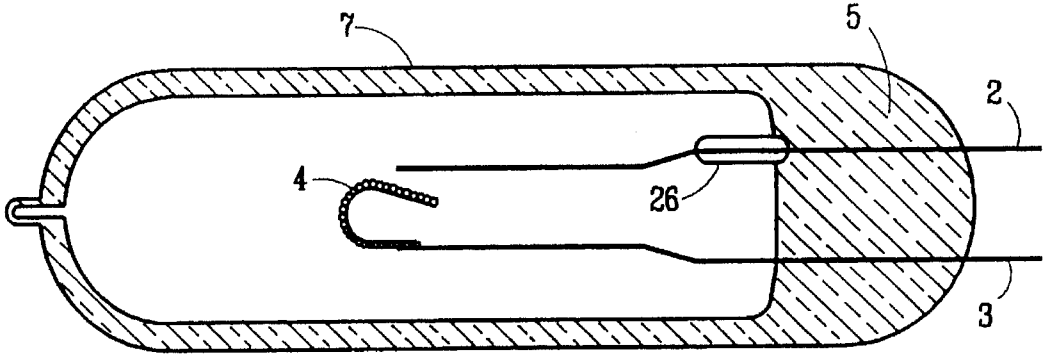
FIGS. 2 and 2A: Illustrates a glowbottle manufactured without a glass bead, in which particles of EL phosphor are dispersed within a glass "frit" fused to one of the lead wires and partially embedded in the glass of the pinch seal.
Figure 2A:
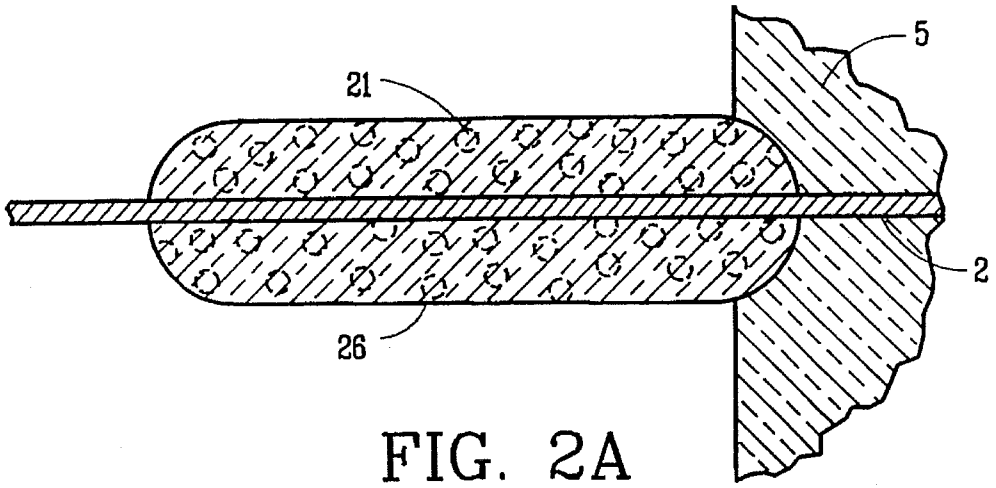

Embodiment 2 (FIG. 2) Many glowbottles are fabricated without beads. The lead wires 2 and 3, with bimetal(s) 4 premounted, are held by their distal ends in a jig while a glass tube enclosing the internal parts is heated and fused to the lead wires in a hermetic pinch seal 5. This is a less-costly method of manufacture than the beaded construction described with reference to FIG. 1. A fritted-layer 26 of EL phosphor 21 in a thin glassy layer, as shown in FIG. 2, may be used to advantage here. A portion of the fritted layer 26 is buried within the glass of the pinch seal 5 to be immersed in the electric field in the glass between the lead wires 2 and 3. In this embodiment, the fritted portion of the lead wire 2 should not extend all the way through the pinch seal 5, to insure hermeticity of the vessel closure. The field strength obtainable is approximately the same as calculated for the beaded case of Embodiment 1.

Figure 3:
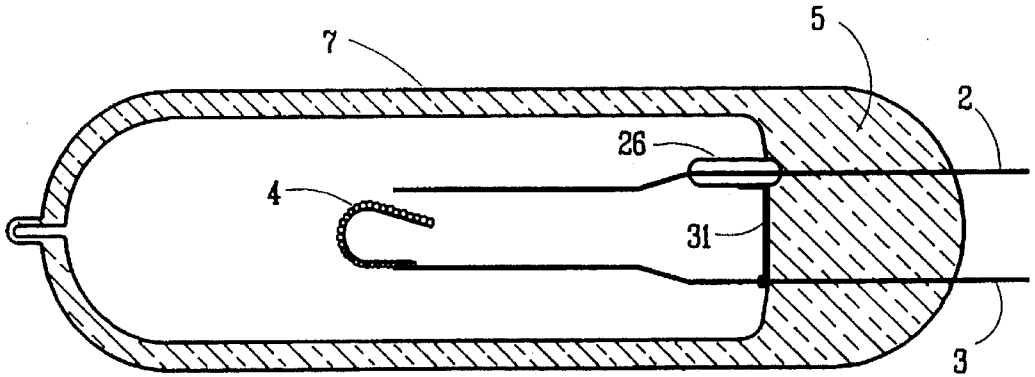
FIGS. 3 and 3A: Illustrates a glowbottle and EL phosphor disposition identical to that of FIG. 2, in which a conductive layer connecting to the opposite lead wire is disposed over part of the surface of the EL phosphor-plus-frit layer.
Figure 3A:
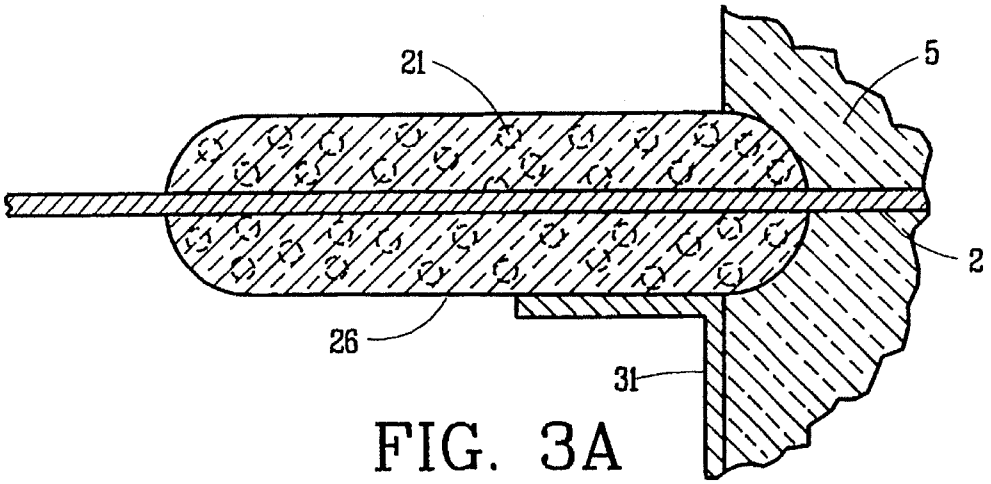

Embodiment 3 (FIG. 3) It may be that the electric field strength which can be obtained in either of the constructions of Embodiments I and 2 is inadequate to provide sufficient EL intensity. This is more likely to be the case for glow-bottles intended for service in compact fluorescent lamps operated from 120-volt power line. The open-circuit voltage is 120 volts, resulting in AC rms electric field strengths of order 2000 volts/cm. The construction shown in FIG. 3 may be used to advantage here. A fritted-lead construction is employed as in Embodiment 2, with a conducting stripe 31 of graphite suspension or silver ink or the like painted over the internal surface of the pinch seal 5 contacting one lead wire 3 directly and covering a part of the surface of the phosphor-frit layer 21. If this layer is 0.005" thick and the open circuit voltage is 120 volts, the field strength is about 9000 volts/cm. This will be adequate to stimulate substantial EL intensity.

Figure 4A:
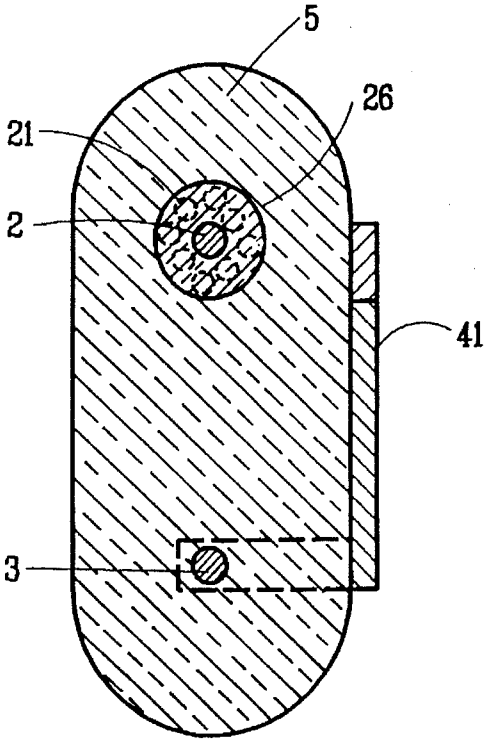
FIGS. 4 and 4A: Illustrates a glowbottle and EL phosphor disposition identical to that of FIG. 2, in which a conductor layer contacting the opposite lead wire is disposed over the external surface of the pinch seal, whereby the EL layer is in the high-electric-field region between the lead wire and the surface conductor layer.
Figure 4:
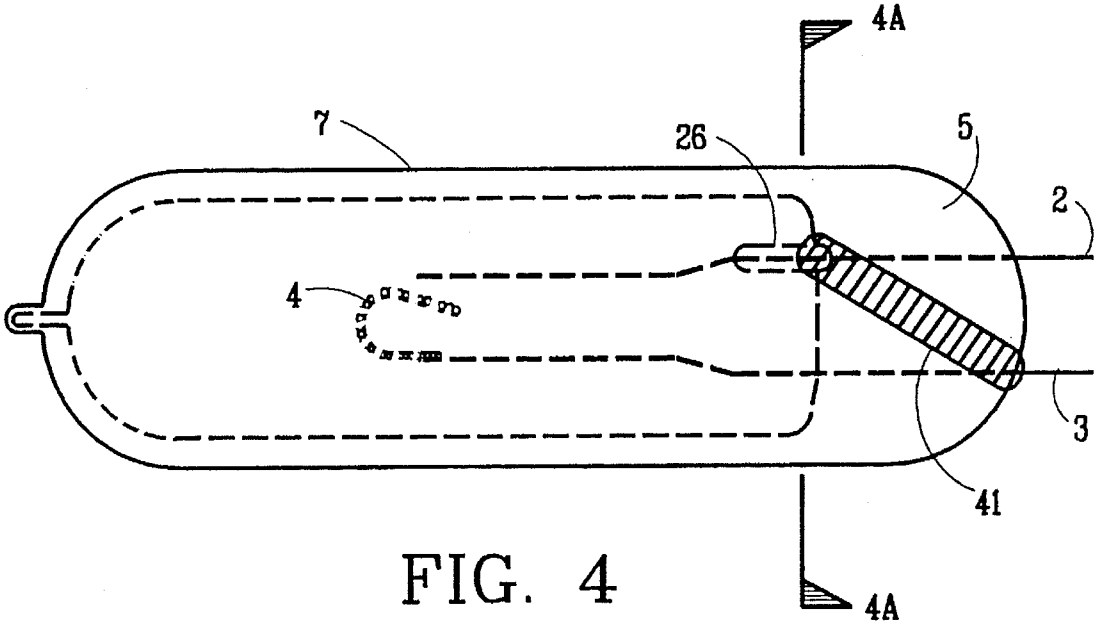

Embodiment 4 (FIG. 4) An alternative construction suitable for 120-volt glowbottles is illustrated in FIG. 4. The same construction of a lead 2 with an EL frit layer 26 used in Embodiment 2 with EL phosphor particles 21 dispersed in the frit is employed in conjunction with a conductor stripe 41 applied to the external surface of the pinch seal 5 contacting the opposite lead wire 3. This establishes the AC potential between the surface of the pinch seal 5 and the internal lead wire 2. The electric field strength at the surface of the lead wire 2 is the same as that between two lead wires with double the voltage between them and twice the separation as the thickness of glass between lead wire and surface stripe. The field strength can be calculated from Equation 1. For example, with 1/16" (0.0625") thickness of glass between lead wire and surface of the pinch, and 120 volts between conductor stripe and lead wire, the field strength may be calculated from Eq. (1) for 240 volts and 0.125" separation of lead wires. For 0.020" diameter lead wire, the field strength will be the same as in Embodiment 1, viz about 4000 volts/cm.

Figure 5:
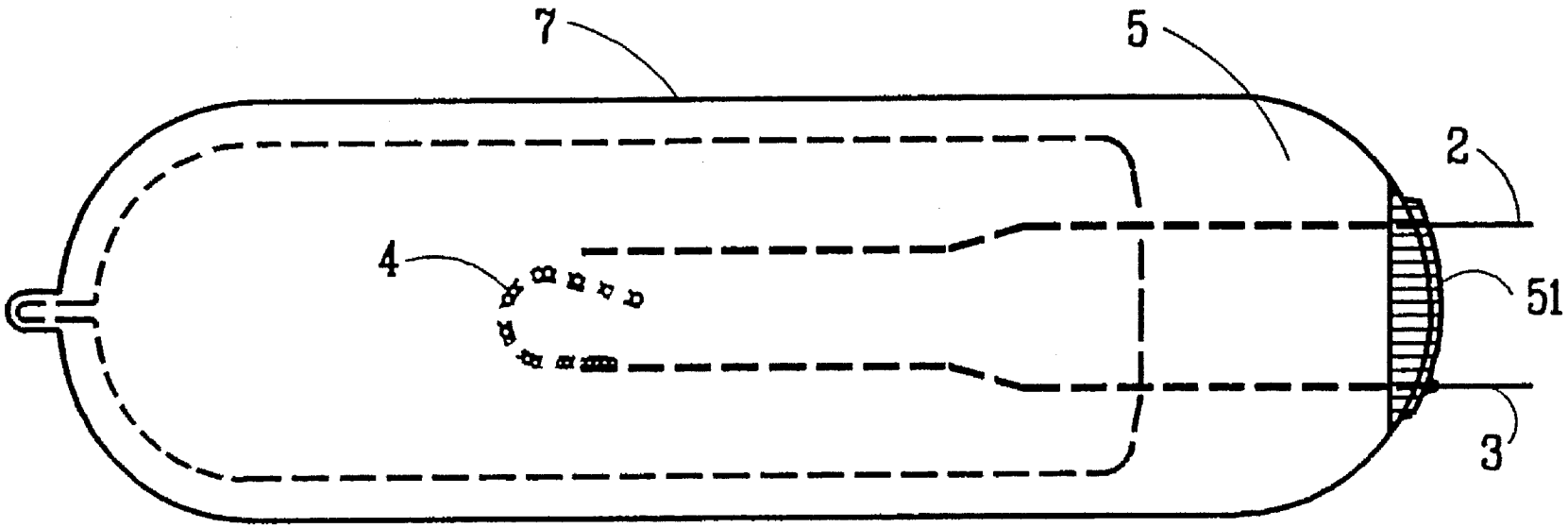
FIG. 5: Illustrates a glowbottle fabricated without a bead in which an EL phosphor in a plastic dielectric is disposed upon the external surface of the pinch seal and contacting both lead wires.

Embodiment 5 (FIG. 5) It may be convenient to take advantage of the light-piping qualities of the glass pinch seal 5 and glass tube walls 7 by disposing the EL phosphor layer on the outside surface of the pinch seal 5, whereby light emitted may be "piped" from an EL source throughout the glass of the pinch 6 and the walls of the tube 7 by total internal reflection. It is possible in this embodiment to disperse the EL phosphor in a plastic dielectric of high dielectric constant, such as the cyano-ethyl-cellulose material known to the prior art of flexible plastic EL lamps. It is known to the prior art that the EL brightness of a given phosphor in a given electric field strength may be increased by several times when this plastic dielectric is employed in place of the glass dielectrics of Embodiments 1–4.

In this embodiment, the EL phosphor is dispersed in a suspension of cyano-ethyl cellulose in dimethyl formamide—acetone solution. A generic description of the preparation of such suspensions is provided in Technical Information Bulletin CM-9238 obtainable from Osram-Sylvania, Inc., Chemical and Metallurgical Products Division, Towanda, Pa. 18848, U.S.A. A plastic-phosphor layer 51 is painted over the end of the pinch seal 5 contacting the lead wires 2 and 3. Again the only high-field region will be in the direct vicinity of the lead wires, where field strengths of order 4000 volts/cm are obtained at 240 volts for the lead wire dimensions and separations already cited.

Because the phosphor-dielectric layer in this embodiment is exposed to the atmosphere, degradation of the phosphor luminescence efficiency by moisture in the atmosphere can occur. Protection from moisture will be necessary for long life. Relatively thick layers of wax, polyester, or epoxy may be disposed over the phosphor layer as moisture barriers. Other proprietary moisture barrier materials may be obtained from commercial suppliers and used to advantage.

Further, it may be advantageous to employ so-called "encapsulated" EL phosphors, to which moisture barrier layers have been applied over individual particles of phosphor by proprietary techniques. Examples of such phosphors, obtainable from the aforementioned Osram-Sylvania, Inc. are: Types 20, 30, 40, and 50, Encapsulated ZnS:Cu (Blue-green-emitting, peak emission wavelength 503, 505, 505, and 507 nm, respectively); Type 60, Encapsulated ZnS;Cu, (Blue-emitting, peak emission wavelength 460 nm). Such phosphors are found to exhibit superior maintenance of EL output in plastic-dielectric lamps.

The development of process steps for the preparation and coating of the EL phosphor suspension and the protection of the coated layer from the atmosphere are matters of routine experimentation to be carried out by one of ordinary skill in the art once the teachings of the invention have been understood and appreciated, and therefore remain within the scope of the invention.

Figure 6A:
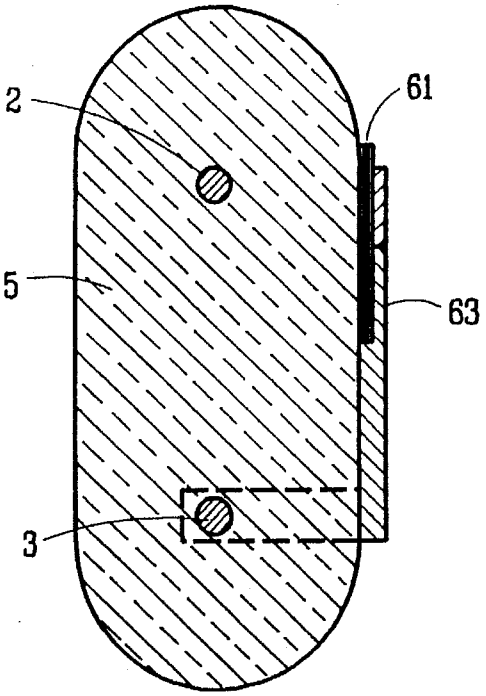
FIGS. 6 and 6A: Illustrates a glowbottle fabricated without a bead in which an EL phosphor in a plastic dielectric is disposed on the outside of the pinch seal with an overlying conductor layer contacting the opposite glowbottle lead wire, whereby the EL layer is in the high electric field region between the conductor layer and the lead wire internal to the pinch seal.
Figure 6:
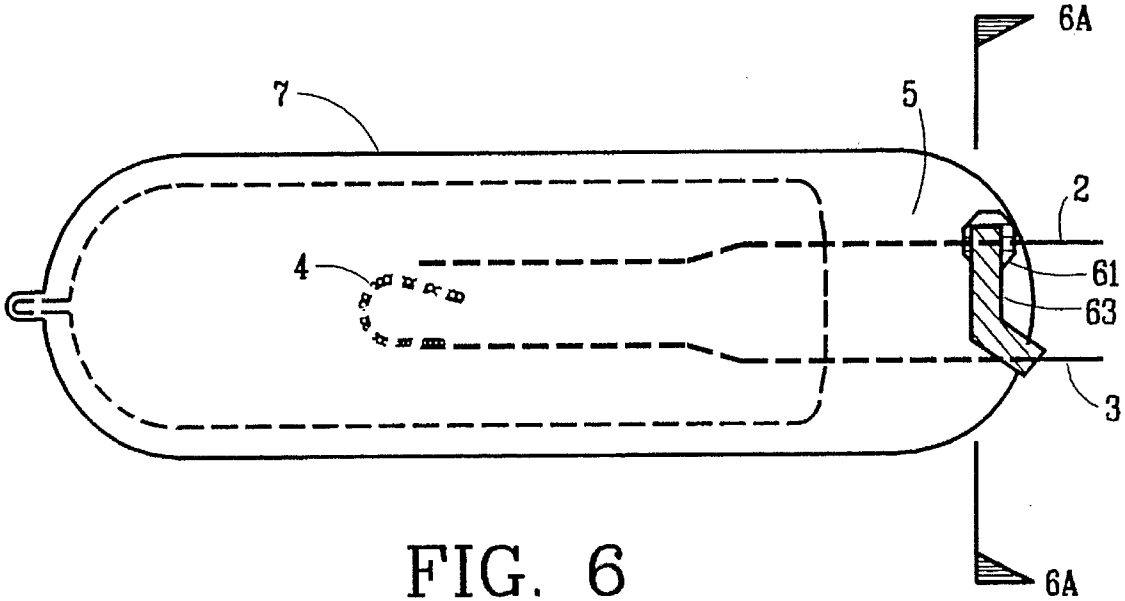

Embodiment 6 (FIG. 6) It may be advantageous to take advantage of the superior EL intensity available from plastic-dielectric EL systems with the construction shown in FIG. 6. An EL phosphor in plastic dielectric 61 is painted over the surface of the pinch seal 5 above one of the lead wires. A conductive stripe contacting the other lead wire is disposed over the surface of the EL film layer. Thus the EL layer is contained in the electric field between the conductive stripe and the lead wire in the pinch seal. The field strength here is relatively low, because there is little field concentration at the conductive stripe, of large area relative to the lead wire. For 240 volts between lead wires, this is about 1200 volts/cm. This will still result in a small EL emission which is well coupled to the interior of the glow-bottle. As before, it may be advantageous to use the encapsulated versions of the EL phosphor materials, and may be necessary to apply an overcoating moisture barrier for long life.

Figure 7A:
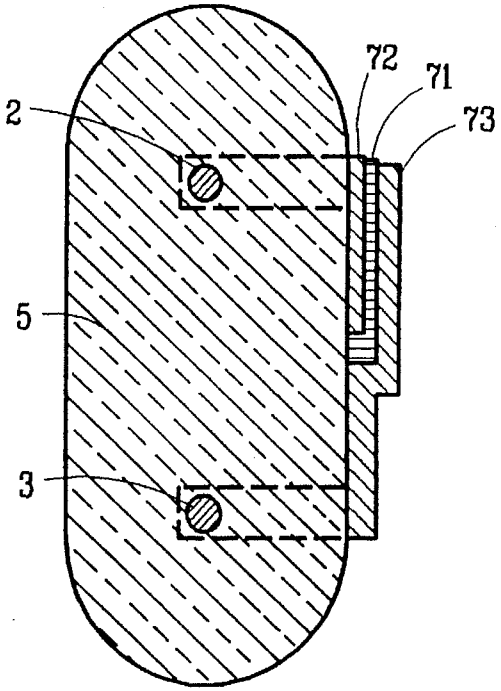
FIGS. 7 and 7A: Illustrates a glowbottle fabricated without a bead but with the EL phosphor in a plastic dielectric sandwiched in a thin layer between two conductor layers, one contacting each glowbottle lead wire, whereby the EL layer is in the very high electric field region between the two conductor layers.
Figure 7:
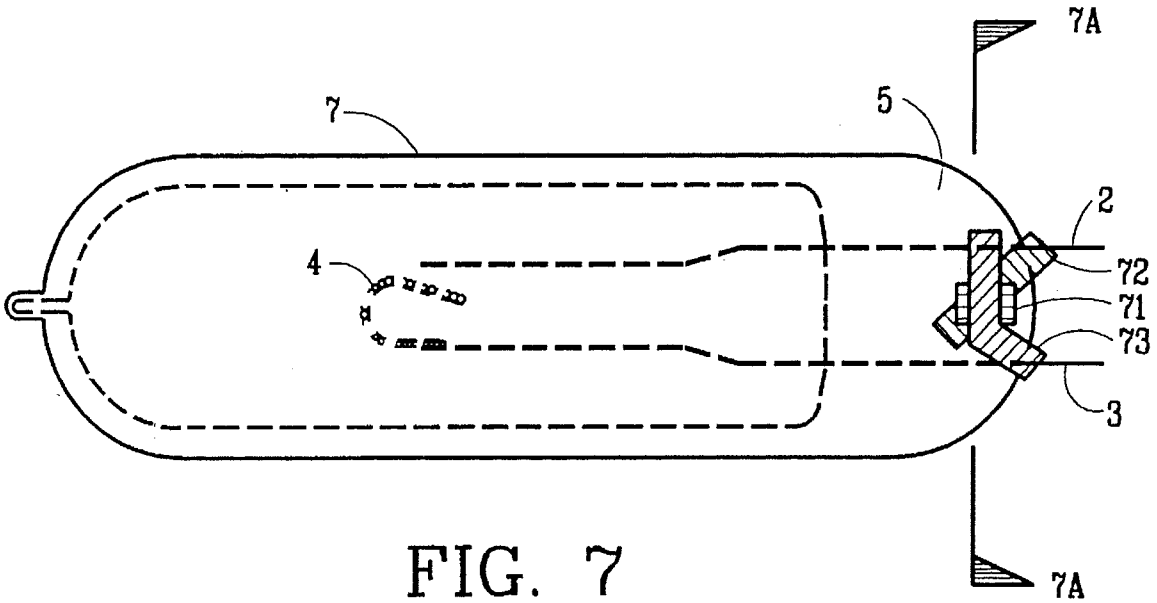

Embodiment 7 (FIG. 7) Another embodiment provides the maximum electric field for energizing the EL phosphor material. An EL phosphor 71 in plastic dielectric is sandwiched between two conductive layers 72 and 73, one connected to each of the lead wires 2 and 3. Thus the field strength is given by the open-circuit voltage divided by the film thickness. If the phosphor-film layer is 0.0025" thick, at 120 volts, the electric field strength is nearly 20,000 volts/cm. The brightness of the EL emission will be the maximum of any of the embodiments. The underneath conductive layer 72 immediately upon the surface of the pinch seal 5 must be applied in a perforated-grid pattern to permit light to enter into the glass of the pinch seal 5 from the EL phosphor layer 71. Again it may be advantageous to employ encapsulated phosphors and to apply a moisture-barrier overcoat over the assembly.

With this embodiment, the EL phosphor-dielectric layer must be very carefully controlled in thickness that it not break down and puncture from the high-voltage pulse generated by the ballast upon opening of the bimetal switch.

Peak voltages may be as high as 1000 volts, which would result in field strengths more than 150,000 volts/cm at the previously-noted 0.0025" thickness. It is common in EL lamp construction to include a so-called "dielectric layer" on top of the EL layer between the conductors, comprising barium titanate particles dispersed in the same cyano-ethyl-cellulose. Such a dielectric layer increases the breakdown strength of the device and helps prevent puncture by transient spike voltages. Typical dielectric layer thicknesses are approximately ⅓ the phosphor-layer thickness. Dielectric layers should not be necessary in any of the other embodiments, because the field strengths are low to begin with.

Figure 8:
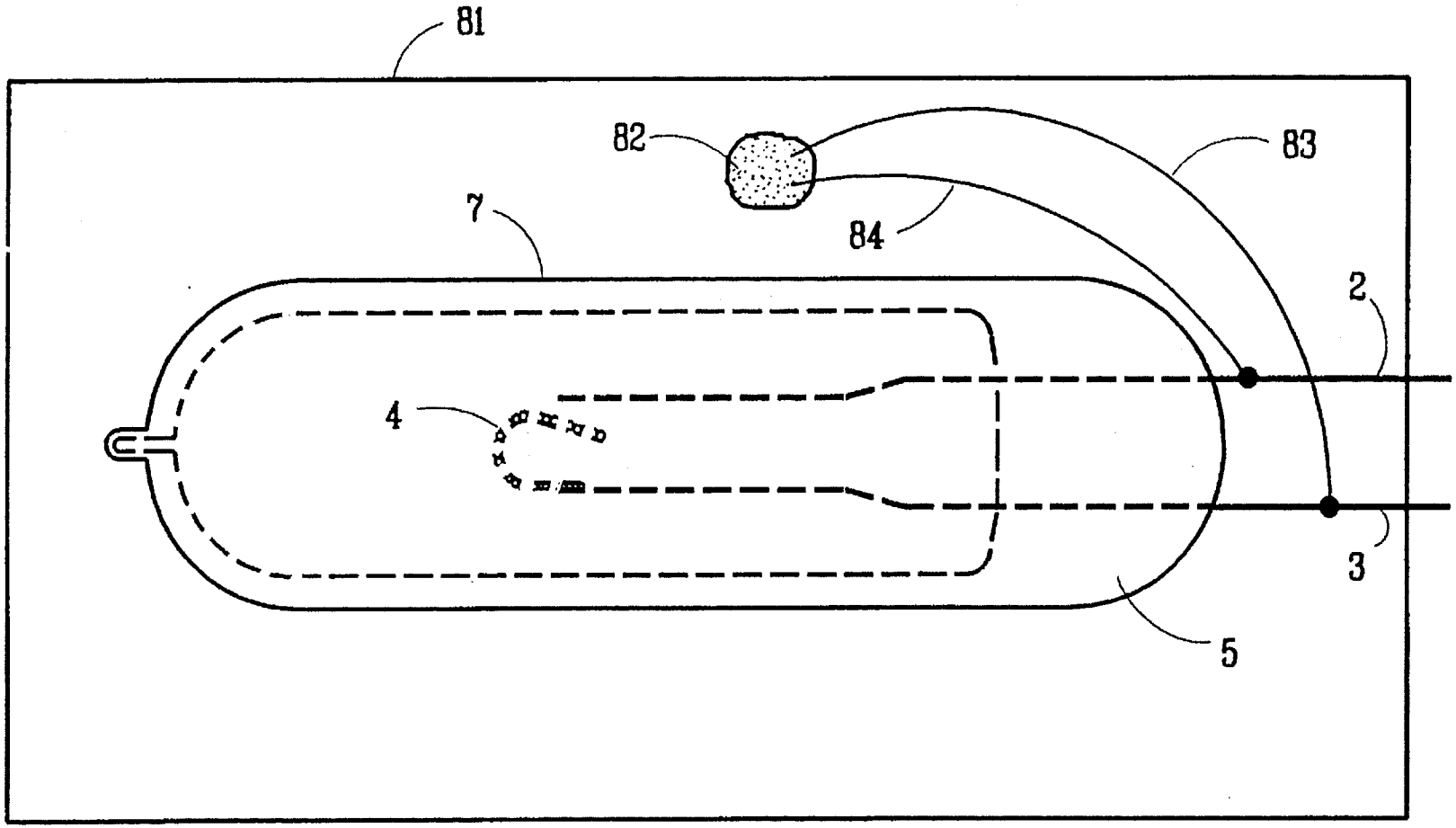
FIG. 8: Illustrates a standard glowbottle within its housing according to the prior art, with an EL-emitting element contained within the housing in an optically-contiguous relationship with the glowbottle, the EL element being energized by voltage applied through contacts affixed to the glowbottle lead wires.

Embodiment 8 (FIG. 8) A standard glowbottle 7 within a standard housing 81 (which can be a conventional can or the internal cavity of the base of a compact fluorescent lamp) is located in proximity to an EL light emitting member 82 which is energized from the voltage across the glowbottle leads 2 and 3 by wires 83 and 84. The EL member 82 may be a glass bead containing dispersed EL phosphor fused in the manner already described to a pair of fine lead wires 82 and 83 connected to the glowbottle lead wires 2 and 3. Alternatively, the EL member may be a dab of plastic dielectric containing dispersed EL phosphor bridging the gap between the fine lead wires 82 and 83. Alteratively still, the EL member may be a miniature film-type EL lamp whose contact lead wires are connected between the glowbottle lead wires as above. The essential feature of mounting a glowbottle in parallel with an EL light emitting source is that the two should be in optically-contiguous relationship, whereby light from the EL source may penetrate to the interior of the glowbottle to stimulate the release of electrons to serve as the initiating electrons for avalanche breakdown. Location of the EL light emitting member near the dome end of the glowbottle may be advantageous since this part receives minimum deposits of material sputtered from the glowbottle electrodes and thereby has maximum transparency for the penetration of light to the interior of the glowbottle.

Figure 9A:
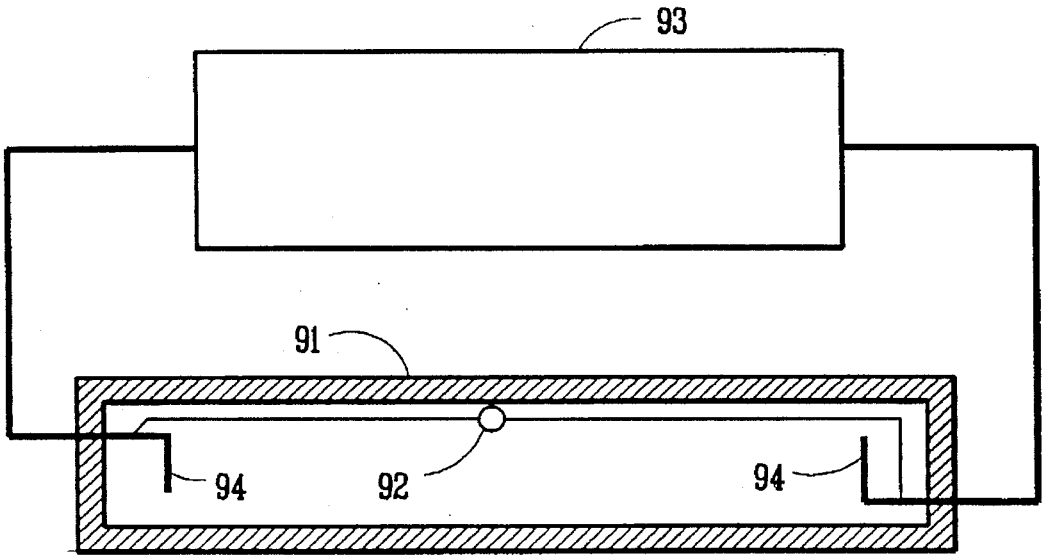
FIGS. 9A and 9B: Illustrate schematic views of gas discharge devices with EL-emitting elements in optically-contiguous relationship either inside or outside of the devices, the devices being in electrical communication with a conventional energizing circuit.
Figure 9B:
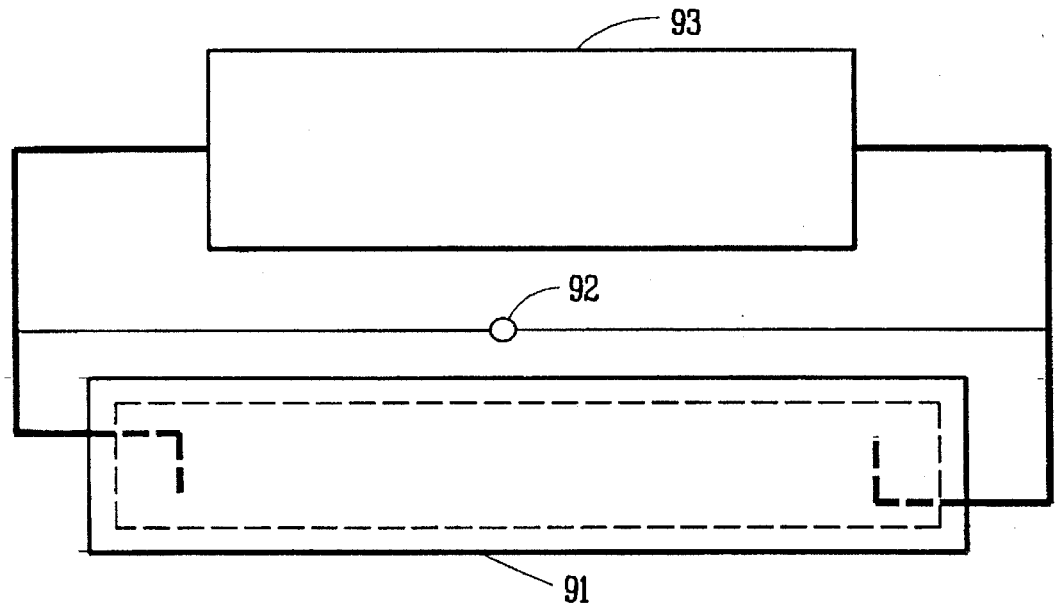

As can be concluded from the foregoing, EL light emitting sources can have wide uses in the starting of many gas discharge devices. FIGS. 9A and 9B illustrate a schematic view of a gas discharge device 91 with a fill comprising an ionizable gas and an EL light emitting element 92 in an optically-contiguous relationship therewith, either inside or outside the device. The device 91 is in electrical communication with a conventional energizing circuit 93. In FIG. 9 the EL element 92 is disposed in series between two electrodes 94 inside of the lamp 93. In FIG. 9A the EL member 92 is disposed in series between two electrodes 94 outside of the lamp 93. The EL element 92 is energized and caused to emit light by the potentials applied to the gas discharge device 91 to provide free electrons by photoelectric emission in the interelectrode gap to serve as initiating elections and aid in the breakdown and ignition of the device.

The foregoing embodiments are intended to be illustrative only and do not define the limits of the invention. Other possible dispositions of EL material, dielectrics and electrical connections will become readily-apparent to one of ordinary skill in the art once the fundamental teaching of the invention are understood and appreciated, and are therefore within the scope of the invention as defined by the following claims.

As my invention I claim:

1. A glowbottle starter switch for igniting gaseous discharge lamps in alternating current circuits, said glowbottle including a hermetically sealed glass envelope containing a fill of an ionizable gas and having at least two lead wires disposed therein and extending to the exterior of said envelope and a bimetal switch disposed on at least one of said lead wires, said switch being arranged to move within a gap to contact the other of said lead wires, the improvement comprising:

an electroluminescent light-emitting means including an electroluminescent phosphor dispersed in a dielectric disposed in optically-contiguous relationship with said glowbottle, said electroluminescent light-emitting means being arranged to be energized to emit light by electric fields produced by alternating voltage between said lead wires, said light emission causing a photoelectric emission of electrons from interior surfaces within the glowbottle envelope to serve as initial electrons for electron avalanches promoting the ionization and breakdown of said gasses within the gap between electrodes of said glowbottle.

2. The glowbottle according to claim 1 wherein the electroluminescent light-emitting means comprises a glass including said phosphor, said electroluminescent light-emitting means being disposed within said envelope and upon at least one of said lead wires.

3. The glowbottle according to claim 2 wherein said electroluminescent light-emitting means is a bead of dielectric glass and phosphor attached to both of said lead wires.

4. The glowbottle according to claim 2 wherein said electroluminescent light-emitting means is disposed on one of said lead wires and further including means electrically connecting said electroluminescent light-emitting means to the other of said lead wires.

5. The glowbottle according to claim 4 wherein said means electrically connecting said bead to the other of said lead wires is an electrically conductive stripe painted on the interior of said envelope.

6. The glowbottle according to claim 2 wherein the electroluminescent light emitting means is disposed on one of said lead wires and further including conductive means disposed on the exterior of said envelope and electrically connected to the other of said lead wires, said conductive means also being disposed on the exterior of said envelope adjacent to the lead wire on which said electroluminescent light-emitting means is disposed.

7. The glowbottle according to claim 6 wherein said conductive means is a metallic stripe painted on the exterior of said envelope.

8. The glowbottle according to claim 1 wherein said envelope is hermetically sealed with a pinch seal of the glass of said envelope and said lead wires extend through said pinch seal from the exterior of said envelope to the interior thereof, said electroluminescent light-emitting means being coated on the exterior of said pinch seal and contacting the exteriors of both of said lead wires, the light emitted from said electroluminescent light-emitting means passing through the interior of said pinch seal into said envelope.

9. The glowbottle according to claim 8 wherein the electroluminescent light-emitting means is an electroluminescent phosphor dispersed in a plastic dielectric.

10. The glowbottle according to claim 1 wherein said envelope is hermetically sealed with a pinch seal of the glass of said envelope, said lead wires extending through said pinch seal from the exterior of said envelope to the interior thereof, said electroluminescent light-emitting means being disposed on the exterior of the pinch seal adjacent one of said lead wires; and electrically conductive means disposed on said pinch seal to connect said electroluminescent means and the other lead wire, the light emitted from said electroluminescent light-emitting means passing through the interior of said pinch seal into said envelope.

11. The glowbottle according to claim 1 wherein said envelope is hermetically sealed with a pinch seal of the glass of said envelope, said lead wires extending through said pinch seal from the exterior of said envelope to the interior thereof, said electroluminescent light emitting means including a pair of conductive means on the exterior of said pinch seal, each of said conductive means being connected to a respective one of said lead wires and an electroluminescent phosphor dispersed in a plastic dielectric being disposed between said conductive means, the light emitted from said electroluminescent light emitting means passing through the interior of said pinch seal into said envelope.

12. A glowbottle starter switch assembly for igniting gaseous discharge lamps in alternating current circuits, said glowbottle assembly including a hermetically sealed glass envelope containing a fill of an ionizable gas and having at least two lead wires disposed therein and extending to the exterior of said envelope and a bimetal switch disposed on one of said lead wires, said switch being arranged to move within a gap to contact the other of said lead wires, said assembly further including container means for said glowbottle, the improvement which comprises:

an electroluminescent light-emitting means including an electroluminescent phosphor dispersed in a dielectric disposed in optically-contiguous relationship with said glowbottle on the outside thereof and within said container means;

means electrically connecting said electroluminescent light-emitting means to said lead wires, said electroluminescent light-emitting means being arranged to be energized to emit light by electric fields produced by alternating voltage between said lead wires, said light emission causing a photoelectric emission of electrons from interior surfaces within the glowbottle envelope to serve as initial electrons for electron avalanches promoting the ionization and breakdown of said gasses within the gap between electrodes of said glowbottle.

13. An electroluminescent light-emitting member disposed in an optically-contiguous relationship with a gaseous discharge device, said electroluminescent light-emitting member being energized by a potential applied to said gaseous discharge device to cause photoelectric emission of electrons within an interelectrode gap within said gaseous discharge device, said electrons serving as initiating electrons to aid in the breakdown and ignition of said gaseous discharge device.

14. In combination with a gaseous discharge device having a pair of spaced electrodes disposed within an envelope containing a fill comprising an ionizable gas;

an electroluminescent light-emitting member disposed in an optically-contiguous relationship with said gaseous discharge device, said electroluminescent light-emitting member being energized and caused to emit light by a potential applied between said electrodes, said energization causing photoelectric emission of electrons within an interelectrode gap within said gaseous discharge device, said electrons serving as initiating electrons to aid in the breakdown and ignition of said gaseous discharge device.

15. The combination according to claim 14 wherein said electroluminescent light emitting means is disposed in a hermetically sealed glass envelope containing a fill of an ionizable gas and having at least two lead wires disposed therein and extending to the exterior of said envelope and a bimetal switch is disposed on at least one of said lead wires, said switch being arranged to move within a gap to contact the other of said lead wires and wherein the electroluminescent light-emitting means includes an electroluminescent phosphor disposed to be energized to emit light by electric fields produced by alternating voltage between said lead wires, said light emission causing a photoelectric emission of electrons from interior surfaces within the sealed glass envelope to serve as initial electrons for electron avalanches promoting the ionization and breakdown of said gasses within the gap between electrodes of said glass envelope.

* * * * *